United States Patent [19]

Su

[11] Patent Number: 5,004,443

[45] Date of Patent: Apr. 2, 1991

[54] ELECTRONIC EYEBALL OF DOLL

[76] Inventor: Michael Su, No. 6, Lane 327, Nan San Road, Chung Ho City, Taipei Hsien, Taiwan

[21] Appl. No.: 468,251

[22] Filed: Jan. 22, 1990

[51] Int. Cl.[5] ..... A63H 3/38

[52] U.S. Cl. ..... 446/392; 446/485

[58] Field of Search ..... 446/392, 485, 389, 219

[56] References Cited

U.S. PATENT DOCUMENTS

| | | | |
|---|---|---|---|
| 1,877,940 | 9/1932 | Morgenstern et al. | 446/392 |
| 2,670,569 | 3/1954 | Heina | 446/392 |
| 3,905,130 | 9/1975 | Gordon et al. | 446/219 X |
| 4,305,223 | 12/1981 | Ho | 446/392 |

FOREIGN PATENT DOCUMENTS

| | | | |
|---|---|---|---|
| 778438 | 7/1957 | United Kingdom | 446/219 |

*Primary Examiner*—Mickey Yu

*Attorney, Agent, or Firm*—Morton J. Rosenberg; David I. Klein

[57] ABSTRACT

This invention relates to an electronic eyeball of doll and in particular to one comprises at least a transparent hemisphere shaped conical connex lens; a non-transparent but diaphaneity screen plate, two non-transparent, non-diaphaneity disc, a transparent film plate and a light source. The screen plate has a hole at its center attached with a color paper. The two discs also have a hole for light emitted from the light source passing through. The film plate also has a hole at its center which attached with a pupil figure. When light emitted from the light source, light will passing through the holes of the second disc, the film plate, the first disc, the screen plate and projecting onto the conical connex lens and thus the eyeball is vividly formed.

1 Claim, 9 Drawing Sheets

ELECTRONIC EYEBALL OF DOLL

BACKGROUND OF THE INVENTION

Dolls have always been a popular toy for children. Many types of dolls have been incorporated into the marketplace. However, prior art doll systems are not generally directed to accessory items for the dolls such as accessories for the dolls directed to movement of pupils of eyes to make the doll appear animated and to make the doll more lifelike for the enjoyment of the children. Childrens dolls have become increasingly more sophisticated in lifelike appearances and functions however, such prior art dolls have generally not incorporated the concept of movement of the eyes of the dolls to provide a more lifelike and interesting appearance.

SUMMARY OF THE INVENTION

This invention concept provides an electronically operated doll eyeball for use with childrens dolls. The electronically operated doll eyeball includes a substantially transparent, hemispherically contcured convex lens as an outer surface of the eyeball of the doll. A diaphanous screen plate member is secured to the convex lens and has a centrally located aperture formed therethrough. The diaphanous screen plate member has a paper member of some predetermined color attached thereto and covering the centrally located aperture. A first dish member has a centrally located first through opening and a second disc opening has a centrally located second through opening. A transparent film plate member is sandwiched between the first and second disc members and secured thereto on opposing sides thereof. The transparent film plate member has a substantially opaque member of predetermined contour secured thereto at a central location. A means for illuminating the convex lens is provided for the overall system. The illumination mechanism includes a board member mounted to the second disc member and which has a plurality of positionally located lighting members mounted thereon. The lighting members are actuated singularly or in combination to provide a changing imaging location of the opaque member on the convex lens dependent upon which of the lighting members is actuated. When the lighting members are deactuated, the opaque member is imaged centrally on the convex lens.

It is a primary object of the present invention concept to provide an electronic eyeball of a doll which makes the doll look more lifelike It is still a further object of the present invention to provide an electronic eyeball which increases the value of the doll and is simple and inexpensive to manufacture.

DESCRIPTION OF THE PREFERRED EMBODIMENTS

Referring now to FIGS. 1–9, there is shown an electronically operated doll eyeball to allow a pupil image 12 to be displaced in varying image areas surrounding the pupil section 11 as shown in FIGS. 4A, 4B–8A, 8B. In the manner to be described in following paragraphs, the image 12 of the pupil member may be seen to move around the imaged area 11 responsive to illumination of lighting mechanism 6 to allow the toy doll to become more lifelike and to provide variations for the enjoyment of children.

Figure 1:
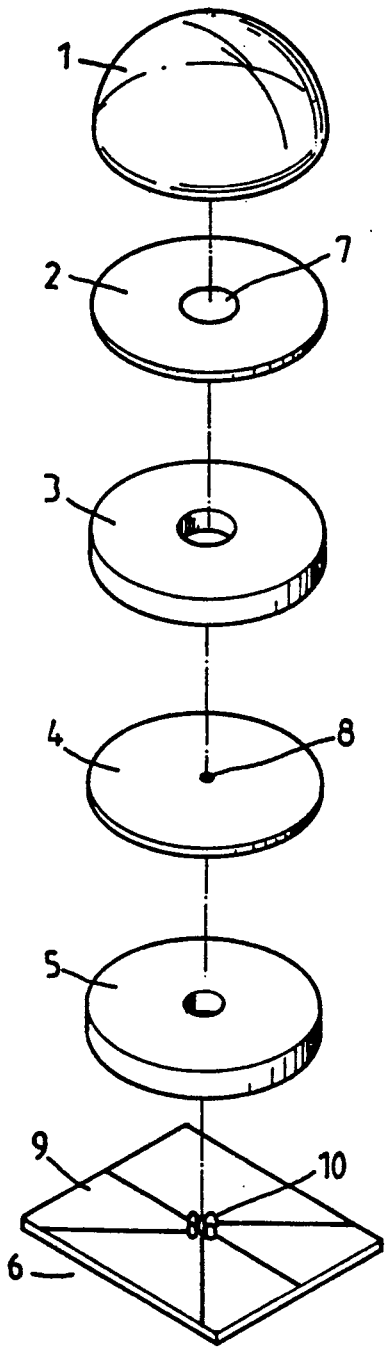
FIG. 1 is a perspective, exploded view of the subject matter of the present invention concept.
Figure 2:
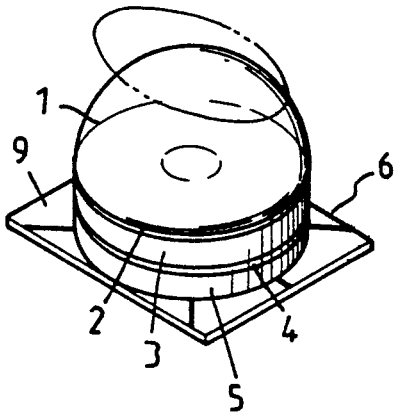
FIG. 2 is a perspective view of the electronically operated doll eyeball.
Figure 3:
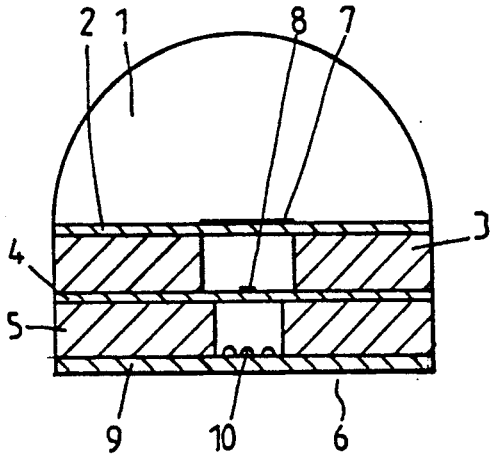
FIG. 3 is a cross-sectional view of the subject electronically operated doll eyeball.

Referring now to FIG. 1, there is shown substantially transparent and hemispherically contoured convex lens 1 upon which imaging takes place and is the outer or top layer of the overall combination as herein described. As is shown in FIGS. 1 and 3, there is provided a diaphanous screen plate member 2 which is secured or coupled to the convex lens 1 and has a centrally located aperture formed therethrough. Diaphanous screen plate member 2 has a paper member 7 which may be of colored material which covers the centrally located aperture.

There is also included first disc member 3 having a centrally located first through opening and a second disc member 5 having a centrally located second through opening. A transparent film plate member 4 is sandwiched between first disc member 3 and second disc member 5 and is secured thereto on opposing sides thereof through adhesive bonding or some like technique not important to the inventive concept as herein described.

Transparent film plate member 4 has a substantially opaque member 8 of predetermined contour secured thereto at a central location of film plate member 4.

As shown in the Figures, substantially opaque member 8 forms the pupil image 12 on convex lens 1 upon actuation of lighting mechanism 6. Opaque member 8 as shown in the Figures is circular in contour to provide an image of a pupil. However, opaque member 8 may be of differing contour and may be in the form of a silhouette of a rabbit if the doll is a rabbit type doll or a bear if the doll is a bear doll.

Figure 9:
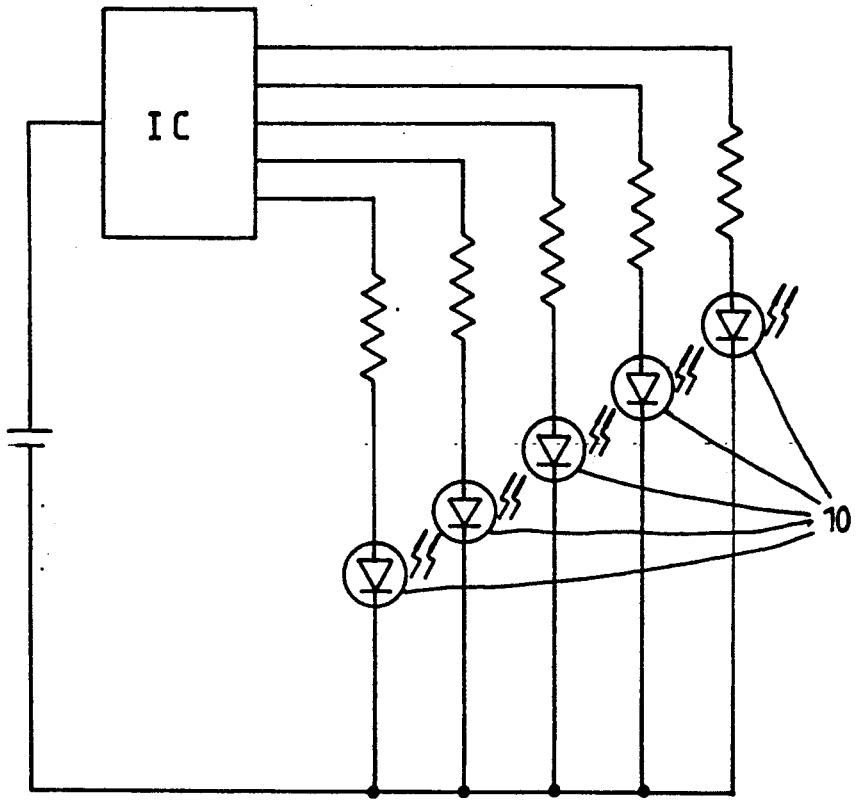

There is provided a mechanism for illumination of the convex lens 1 and provides for a lighting mechanism 6 which further includes a board member 9 having a plurality of LEDs or bulbs 10 attached thereto and driven by a commonly used IC circuit well known in the art having simple circuitry as shown in FIG. 9. Light bulbs or lighting members may be actuated singularly or in combination to provide changing image locations of opaque member 8 on convex lens 1 as viewed by an external observer. Obviously, when bulbs 10 are deactuated, opaque member 8 will appear to be centrally located in the image formed on convex lens 1.

FIG. 9 is a schematic diagram of the electrical circuit showing five LEDs or light bulbs controlled by an integrated circuit to allow individual lighting to project opaque member 8 onto the convex lens 1 at the differing positions as shown in the Figures.

Figure 4B:
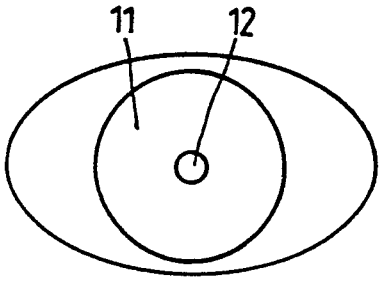
FIG. 4B is a planar view of the electronically operated eyeball showing the pupil member centrally located.
Figure 4A:
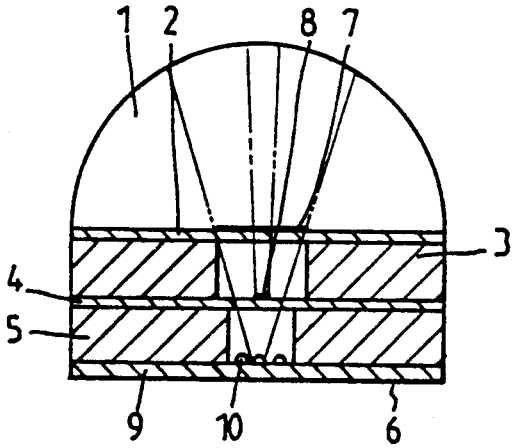
FIG. 4A is a cross-sectional view of the doll eyeball wherein the pupil portion is centrally located.

As an example, referring now to FIGS. 4A and 4B the bulbs or LEDs 10 image and light convex lens 1 through the second hole of second disc member 5, transparent film plate 4, first disc member 3 and diaphanous screen plate member 2. Image 12 is formed substantially central within imaged area 11 surrounding the pupil section. Thus, if a centrally located light bulb 10 is actuated, the image 12 will be displayed at the center of the convex lens 1 as shown in FIG. B.

Figure 5B:
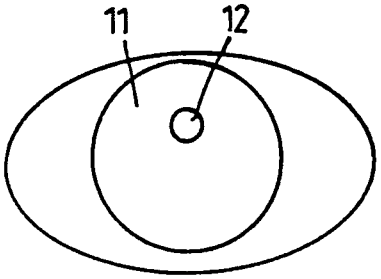
FIG. 5A and 5B is a cross-sectional view and a planar view of the electronically operated eyeball showing the pupil portion being imaged at an upper area of the convex lens.
Figure 5A:
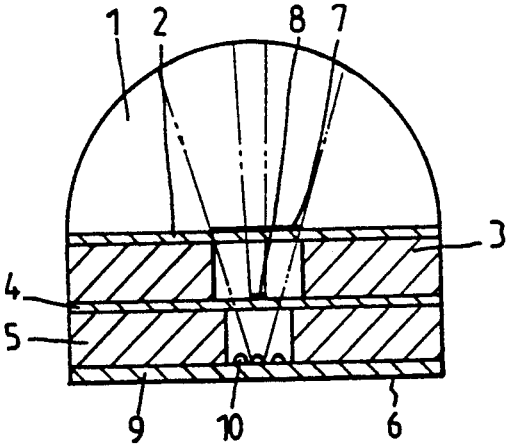
Figure 6B:
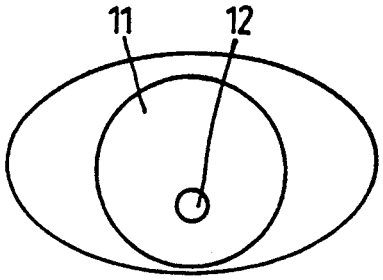
FIGS. 6A and 6B are respectively cross-sectional and planar views of the electronically operated eyeball showing the pupil member imaged on a lower section of the convex lens.
Figure 6A:
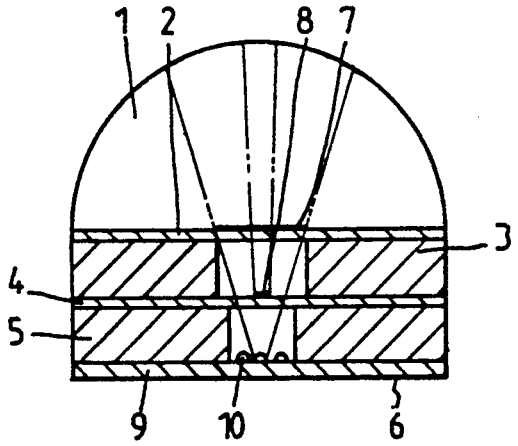
Figure 7B:
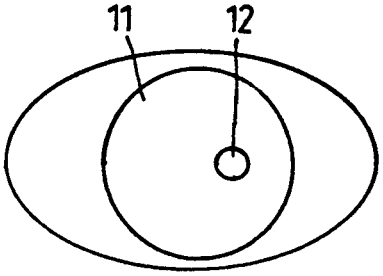
FIGS. 7A and 7B are respectively cross-sectional and planar views of the electronically operated eyeball showing the pupil member imaged to a right side of the convex lens.
Figure 7A:
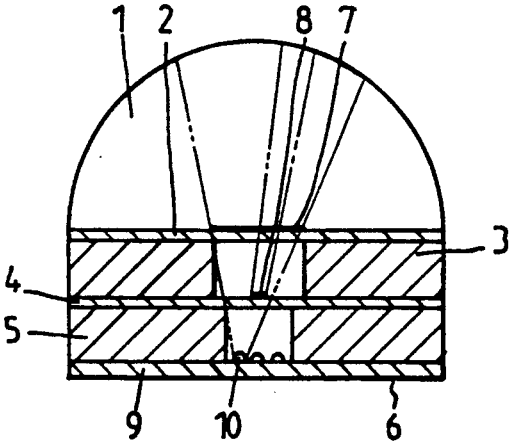
Figure 8B:
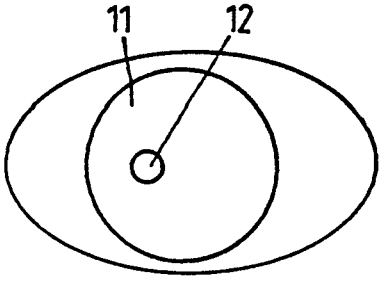
FIGS. 8A and 8B are respectively cross-sectional and planar views of the electronically operated eyeball showing the pupil member being imaged to the left portion or section of the convex lens; and, FIG. 9 is a circuit diagram for the illumination means of the subject invention concept.
Figure 8A:
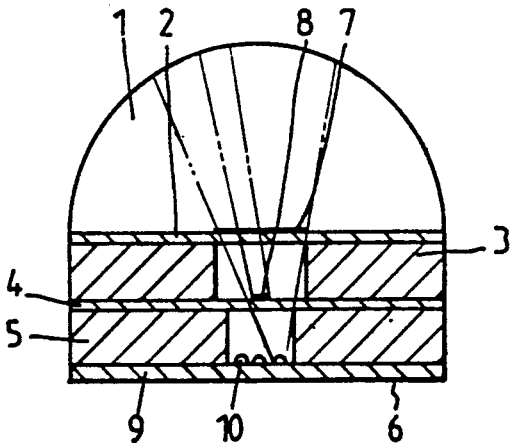

If a lower bulb 10 of the illumination mechanism 6 is actuated, the pupil image 12 will be displayed at an upper portion of convex lens 1 as shown in FIGS. 5A and 5B. If an upper bulb 10 of lighting mechanism 6 is actuated, the opaque member image 12 will be displayed at a bottom portion of the convex lens 1 as shown in FIGS. 6A and 6B. Similarly, FIGS. 7A and 7B as well as 8A and 8B show differing light bulb actuation to provide positional location movement of image 12 on convex lens 1.

I claim:

1. An electronically operated doll eyeball comprising:

(a) a substantially transparent, hemispherically contoured convex lens;

(b) a diaphanous screen plate member secured to said convex lens and having a centrally located aperture formed therethrough, said diaphanous screen plate member having a paper member of predetermined color attached thereto and covering said centrally located aperture;

(c) a first disc member having a centrally located first through opening;

(d) a second disc member having a centrally located second through opening;

(e) a transparent film plate member sandwiched between said first and second disc members and secured thereto on opposing sides thereof, said transparent film plate member having a substantially opaque member of predetermined contour secured thereto at a central location; and, (f) means for illuminating said convex lens, said means for illuminating including a board member mounted to said second disc member and having a plurality of positionally located lighting members mounted thereto, said lighting members being actuated singularly or in combination to provide a changing imaging location of said opaque member on said convex lens dependent upon which of said lighting members is actuated, said opaque member being imaged centrally on said convex lens when all of said lighting members are deactuated.

* * * * *